US007500648B2

(12) United States Patent
Kammerer et al.

(10) Patent No.: US 7,500,648 B2
(45) Date of Patent: Mar. 10, 2009

(54) FUEL-INJECTION VALVE

(75) Inventors: Werner Kammerer, Vaihingen (DE); Klaus Noller, Oppenweiler (DE); Hubert Stier, Vaihinger/Enz (DE); Dietmar Schmieder, Markgroeningen (DE); Michael Huebel, Gerlingen (DE); Thomas Gerschwitz, Eberdingen (DE); Christian Leitner, Eltmann (DE)

(73) Assignee: Robert Bosch GmbH, Stuttgart (DE)

( * ) Notice: Subject to any disclaimer, the term of this patent is extended or adjusted under 35 U.S.C. 154(b) by 305 days.

(21) Appl. No.: 10/547,401

(22) PCT Filed: Feb. 14, 2004

(86) PCT No.: PCT/DE2004/000280

§ 371 (c)(1),
(2), (4) Date: May 31, 2006

(87) PCT Pub. No.: WO2004/076845

PCT Pub. Date: Sep. 10, 2004

(65) Prior Publication Data

US 2006/0289682 A1 Dec. 28, 2006

(30) Foreign Application Priority Data

Feb. 27, 2003 (DE) ..... 103 08 635

(51) Int. Cl.
*F16K 31/12* (2006.01)

(52) U.S. Cl. ..... 251/57; 251/51

(58) Field of Classification Search ..... 251/51, 251/57

See application file for complete search history.

(56) References Cited

U.S. PATENT DOCUMENTS

| | | | | |
|---|---|---|---|---|
| 4,858,439 | A | 8/1989 | Sawada et al. | |
| 6,766,965 | B2 * | 7/2004 | D'Arrigo | 239/102.2 |
| 6,823,673 | B2 * | 11/2004 | Cheng | 60/481 |
| 6,832,749 | B2 * | 12/2004 | Schuerg et al. | 251/129.06 |
| 7,066,399 | B2 * | 6/2006 | Hohl | 239/102.2 |
| 7,077,377 | B2 * | 7/2006 | Schurz | 251/54 |

FOREIGN PATENT DOCUMENTS

| | | |
|---|---|---|
| DE | 37 42 241 | 8/1988 |
| DE | 195 00 706 | 7/1996 |
| DE | 197 08 304 | 9/1998 |
| DE | 199 12 666 | 9/2000 |
| DE | 199 50 760 | 4/2001 |
| DE | 100 53 928 | 5/2002 |

(Continued)

*Primary Examiner*—John K Fristoe, Jr.
(74) *Attorney, Agent, or Firm*—Kenyon & Kenyon LLP

(57) ABSTRACT

A fuel injector has a piezoelectric or magnetostrictive actuator, which actuates a valve-closure member cooperating with a valve-seat surface a sealing seat. An hydraulic coupler includes a master piston, a slave piston, and a coupler volume formed in-between, the coupler volume being connected to a compensating chamber via a throttle. An elastic flexible section delimits the compensating chamber at least partially, and the coupler volume, the throttle, and the compensating chamber are filled with an hydraulic medium. The flexible section exerts a pressure on the hydraulic medium due to prestressing, and the force of a compression spring, which is braced either directly and/or via fixed components on the slave piston and the master piston, is directed with an initial stress in such a way that the force enlarges the coupler volume.

23 Claims, 3 Drawing Sheets

FOREIGN PATENT DOCUMENTS

| | | |
|---|---|---|
| DE | 101 48 594 | 4/2003 |
| DE | 101 62 045 | 6/2003 |
| EP | 0 477 400 | 4/1992 |
| EP | 1 378 657 | 1/2004 |
| WO | WO 01/29403 | 4/2001 |
| WO | 02 25096 | 3/2002 |

* cited by examiner

FUEL-INJECTION VALVE

FIELD OF THE INVENTION

The present invention is based on a fuel injector.

BACKGROUND INFORMATION

From European Published Patent Application No. 0 477 400, a system for an adaptive, mechanical tolerance compensation acting in the lift direction is known for a travel transducer of a piezoelectric actuator for a fuel injector. In the process, the actuator lift is transmitted via an hydraulic chamber. The hydraulic chamber has a defined leak with a defined leakage rate. The actuator lift is introduced into the hydraulic chamber via a transmitter piston and transmitted to an element to be driven via a receiver piston. This element is, for example, a valve needle of a fuel injector.

Guided in the master cylinder is a slave piston, which also seals the master cylinder and thereby forms the hydraulic chamber. Arranged in the hydraulic chamber is a spring that presses apart the master cylinder and the slave piston. When the actuator transmits a lift movement to the master cylinder, this lift movement is transmitted to the slave piston by the pressure of an hydraulic fluid in the hydraulic chamber since the hydraulic fluid in the hydraulic chamber is unable to be compressed and only a small fraction of the hydraulic fluid is able to escape through the annular gap during the short duration of a lift. In the rest phase, when the actuator exerts no compressive force on the master cylinder, the spring pushes the slave piston out of the cylinder and, due to the generated vacuum pressure, the hydraulic fluid penetrates the hydraulic chamber and replenishes it via the annular gap. In this way, the hydraulic coupler automatically adapts to linear deformations and pressure-related expansions of a fuel injector. The hydraulic medium is sealed via sealing rings.

Also known from the related art are fuel injectors that seal the hydraulic medium with seals in the shape of a corrugated tube or convoluted bellows. Disadvantageous in this known related art is that the restoring force is generated solely by the spring. Changes in the behavior of the spring, for instance due to ageing, therefore have a greater effect on the restoring force and thus on the coupler's behavior. Furthermore, the size of the spring is larger.

SUMMARY OF THE INVENTION

In contrast, the fuel injector according to the present invention has the advantage over the related art that the coupler is able to be manufactured in a simple and cost-effective manner, has a less complicated design and is reliable in continuous running; in addition, its behavior is less dependent on the operating duration.

In first further developments, the compensating chamber is connected to the throttle via a transverse bore, and/or the compression spring has a helical design. This makes for an especially simple design of the coupler.

Due to the cup-shaped form of a first slave section of the slave piston whose floor partially delimits the coupler volume, the axial guidance of the first slave section with a guide play in the master piston, the partially cup-shaped enclosure of the first slave section by the master piston, and the arrangement of the throttle in the bottom of the cup-shaped first slave section, the coupler is able to be constructed in an especially compact and simple as well as cost-effective manner.

In another further development, the throttle includes a throttling ball which is guided by a throttling gap in an opening. This provides for a simple design of the throttle, and the compression spring is able to be supported on a surface of the master piston delimiting the coupler volume in an uncomplicated manner via the throttling ball, thereby resulting in another simple and compact design.

The hole-disk or sleeve-shaped design through the axial section and the radial section allows a space-saving and simple affixation of the flexible section.

A simple, reliable and, in particular, hermetically sealing affixation of the flexible section is also advantageously achieved in that the end formed on the radial section engages with a second recess formed at the slave piston and/or in that the end formed on the axial section engages with a recess arranged on the master piston. This may be improved further by a cavity-shaped design of the recesses, clamped affixation of the ends and by thickened ends.

In another further development, the ends of the flexible section are folded over to the inside, forming a cavity in the process. The ends advantageously engage with the recesses in a hermetically sealing manner. This makes it possible to utilize the internal pressure of the compensating chamber to press the ends of the flexible section against the recesses in an hydraulically sealing manner by pressure transmission via the hydraulic medium, thereby achieving reliable and durable sealing.

DETAILED DESCRIPTION

In the following, exemplary embodiments of the present invention are described by way of example.

Figure 1:
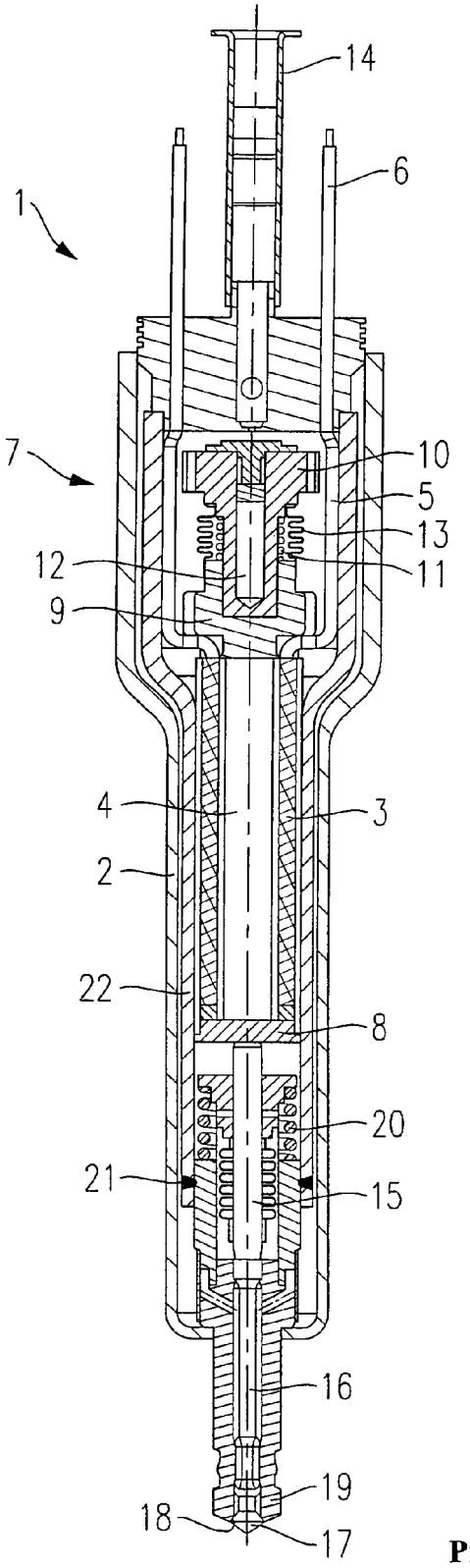
Fig. 1 Prior Art
FIG. 1 shows a schematic section through a fuel injector configured according to the related art.
Figure 2:
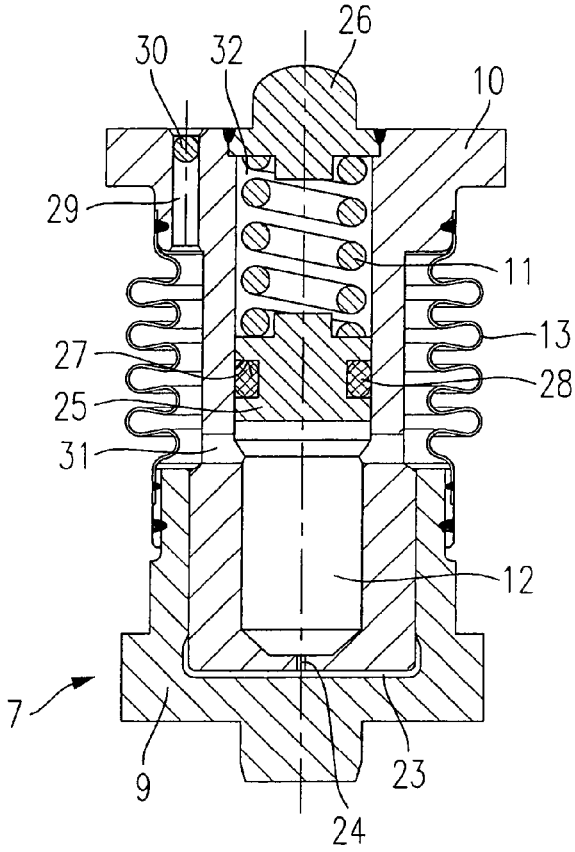
Fig. 2 Prior Art
FIG. 2 shows a schematic cut-away portion of a fuel injector according to the related art, in the region of the coupler, similar to the fuel injector shown in FIG. 1.

Before the present invention is described in greater detail with the aid of preferred specific embodiments, the essential components of a fuel injector according to the related art shall be briefly explained in FIGS. 1 and 2 for better understanding. Identical parts are provided with matching reference numerals in the figures.

Fuel injector 1 shown in FIG. 1 is configured in the form of a fuel injector for fuel-injection systems of mixture-compressing internal combustion engines with externally supplied ignition. Fuel injector 1 is especially suited for the direct injection of fuel into a combustion chamber (not shown) of an internal combustion engine. Fuel injector 1 includes a housing 2 in which a piezoelectric or magnetostrictive actuator 4 provided with an actuator extrusion coat 3 is arranged. An electrical voltage is able to be supplied to actuator 4 via an electrical line 5 at which an electrical connection 6 which projects beyond housing 2 may be formed. On the intake side, actuator 4 rests against a master piston 9 of an hydraulic coupler 7, and on the discharge side it rests against an actuator head 8. Hydraulic coupler 7 also includes a slave piston 10, a compression spring 11 that applies an initial stress to hydraulic coupler 7, and a compensating chamber 12 which is filled with an hydraulic medium. The fuel is centrally supplied via an intake 14.

A detailed description of coupler 7 and its function can be gathered from the description in connection with FIG. 2.

Arranged on the discharge side of actuator head 8 is an actuating element 15 that acts on a valve needle 16. Valve needle 16 is provided with a valve-closure member 17 at its discharge-side end. Valve-closure member 17 cooperates with a valve-seat surface 18 formed on a nozzle body 19 to form a sealing seat. A restoring spring 20 acts on valve needle 16 in such a way that fuel injector 1 remains in the closed state when actuator 4 is not energized. It also resets valve needle 16 after the injection phase.

A welding seam 21 fixes nozzle body 19 in place in an inner housing 22 that seals actuator 4 from the fuel. Fuel flows from intake 14 between housing 2 and inner housing 22 to the sealing seat.

FIG. 2 shows a coupler 7 that is similar in its structure to that of coupler shown in FIG. 1. Hydraulic couplers 7 in fuel injectors 1 are usually designed to convert or translate the lift of actuator 4 to valve needle 16 on the one hand, and/or to compensate for temperature-related linear changes in actuator 4 and housing 2 on the other hand. As shown in the exemplary embodiment, the latter is realized with the aid of coupler 7 designed as secondary-medium coupler, which contains an hydraulic medium that does not come into contact with the fuel. The hydraulic medium fills compensating chamber 12 and a coupler volume 23 formed between master piston 9 and slave piston 9, the coupler volume being connected to compensating chamber 12 via a throttle 24.

Compensating chamber 12 is disposed within and outside of slave piston 10, the two parts being interconnected by a transverse bore 31, and the portion of compensating chamber 12 situated outside being sealed from the fuel flowing through fuel injector 1 by way of a flexible section 13 designed as a corrugated tube seal.

In response to temperature changes, the hydraulic medium between coupler volume 23 is exchanged with compensating chamber 12 via throttle 24. The required charging pressure is generated by compression spring 11 disposed in slave piston 10 in a pressure reservoir 32. The spring is arranged between a first closure member 25 and a second closure member 26, the former having a groove 27 with a sealing ring 28 disposed therein to seal coupler chamber 12.

The filling of coupler 7 with hydraulic medium, for instance in the course of production, is implemented via a channel 29 which may be sealed by a pressed-in closure ball 30, for example.

Figure 3:
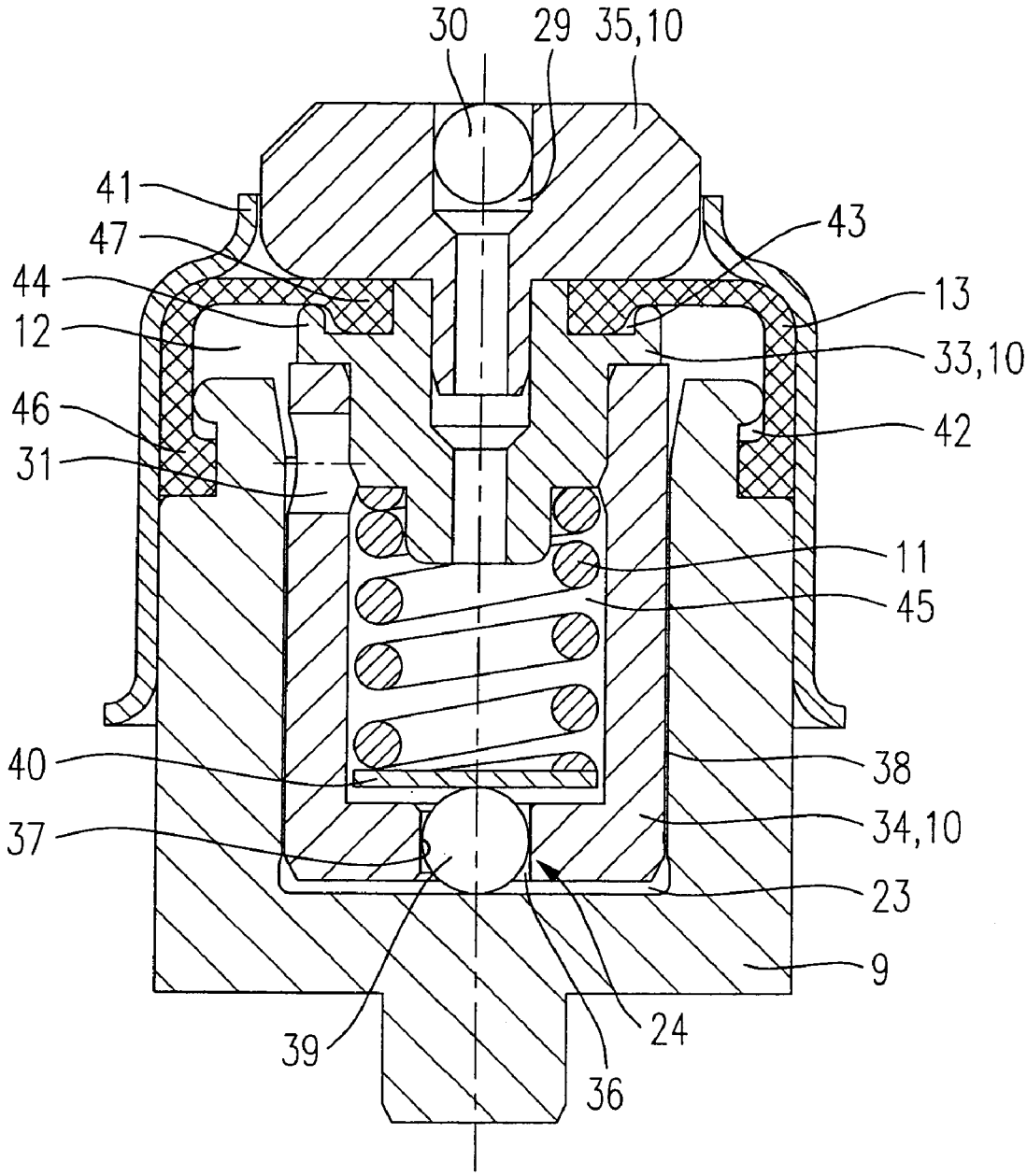
FIG. 3 shows an exemplary embodiment of a fuel injector configured according to the present invention, in the region of the coupler.

FIG. 3 shows an exemplary embodiment of a coupler 7 for a fuel injector 1 configured according to the present invention. Via a cup-shaped first slave section 34, slave piston 10 engages with the hollow-cylindrical master piston 9 sealed on one side. Slave piston 10 or first slave section 34 is guided in master piston 9 so as to be axially displaceable with a guidance gap 38. Guidance gap 38 is relatively small, the quantity of hydraulic medium flowing through guidance gap 38 being very small. In other exemplary embodiments, guidance gap 38 may have a throttle function.

In this exemplary embodiment, slave piston 10 is made up of first slave section 34, a second slave section 35, and a connection section 33. By its sealed end, first slave section 34 together with the base of master piston 9 delimits coupler volume 23, throttle 24 being centrally disposed in the sealed end of first slave section 34. Throttle 24 is made up of an opening 36 centrally arranged in the base of cup-shaped first slave section 24, and a throttling ball 39 which is guided therein with a throttling gap 37.

The open end—facing away from coupler volume 23—of first slave section 34 is sealed by connection section 33. Connection section 33 partially engages with first slave section 34 and is immovably joined thereto by pressing or welding. Arranged between the end of connection section 33, engaging with first slave section 34, and throttling ball 39 is compression spring 11, which is prestressed and arranged in spring cavity 45 disposed in first slave section 34.

Compression spring 11 is helical and exerts pressure on throttling ball 39; a spring washer 40 is interposed and throttling ball 39 is braced at the base of master piston 9 in coupler volume 23. The upper ends, facing away from coupler volume 23, of first slave section 34 and of master piston 9 are arranged at approximately the same height; connection section 33 rests on the upper end of first slave section 34 by way of a flange 44 and partially projects beyond first slave section 34. Flange 44 has approximately the same diameter as first slave section 34.

Compensating chamber 12 is delimited by flexible section 13, connection section 33, or by flange 44, master piston 9 and first slave section 34; compensating chamber 12 being connected to throttle 24 via transverse bore 31 and spring cavity 45. Flexible section 13 is elastic and made of an elastomeric material, for instance, or steel.

In this exemplary embodiment, flexible section 13 is divided into an axial section 46 extending in an axial direction with respect to the travel direction of slave piston 10, and a radial section 47 extending radially with respect to the travel direction of slave piston 10. Flexible section 13, which is disk- and sleeve-shaped as a result, is thickened at its ends. Flexible section 13 rests inside a second recess 43 via the end formed on radial section 47, second recess 43 being formed at the side of flange 44 facing away from coupler volume 23. Via its end formed on axial section 46, it rests in a first recess 42, which is disposed in the region of the upper end of master piston 9 at its outer surface. Recesses 42, 43 are in the shape of a cavity.

Second slave section 35, which rests on top of connection section 33 and partially engages with it, presses the thickened end formed on radial section 47 into second recess 43 in a hermetically sealing manner, fixing it in place in the process. A sleeve 41 that partially encloses master piston 9 presses the end, formed on axial section 46, of flexible section 13 into first recess 42 in a hermetically sealing manner so that it is fixed in place in this manner.

The sleeve encloses axial section 46 and the transition to radial section 47 in a form-locking manner, sleeve 41 thus being used to delimit the expansion. Toward the top, the sleeve continues past axial section 46 in tapering form, enclosing second slave section 35 at least partially in the radial direction and in a form-fitting manner with slight play.

Forces acting on coupler 7 in the axial direction for longer periods of time such as they occur, for example, in a temperature-related expansion of actuator 4, cause coupler volume 23 to become smaller due to hydraulic medium flowing from coupler volume 23 through throttle 24 via spring cavity 45 and transverse bore 31 into compensating chamber 12, which is partially delimited by elastic and diaphragm-like flexible section 13. Because of prestressing of flexible section 13 and compression spring 11, a pressure that enlarges coupler volume 23 is exerted on the hydraulic medium, compression spring 11 pressing master piston 9 and slave piston 10 apart only via fixed components, without acting via the hydraulic medium.

Compression spring 11 may also be arranged outside spring cavity 45.

The dynamic rigidity of coupler 7 is defined in particular by the size and shape of throttling gap 37 and possibly the size and shape of guiding gap 38.

Figure 4:
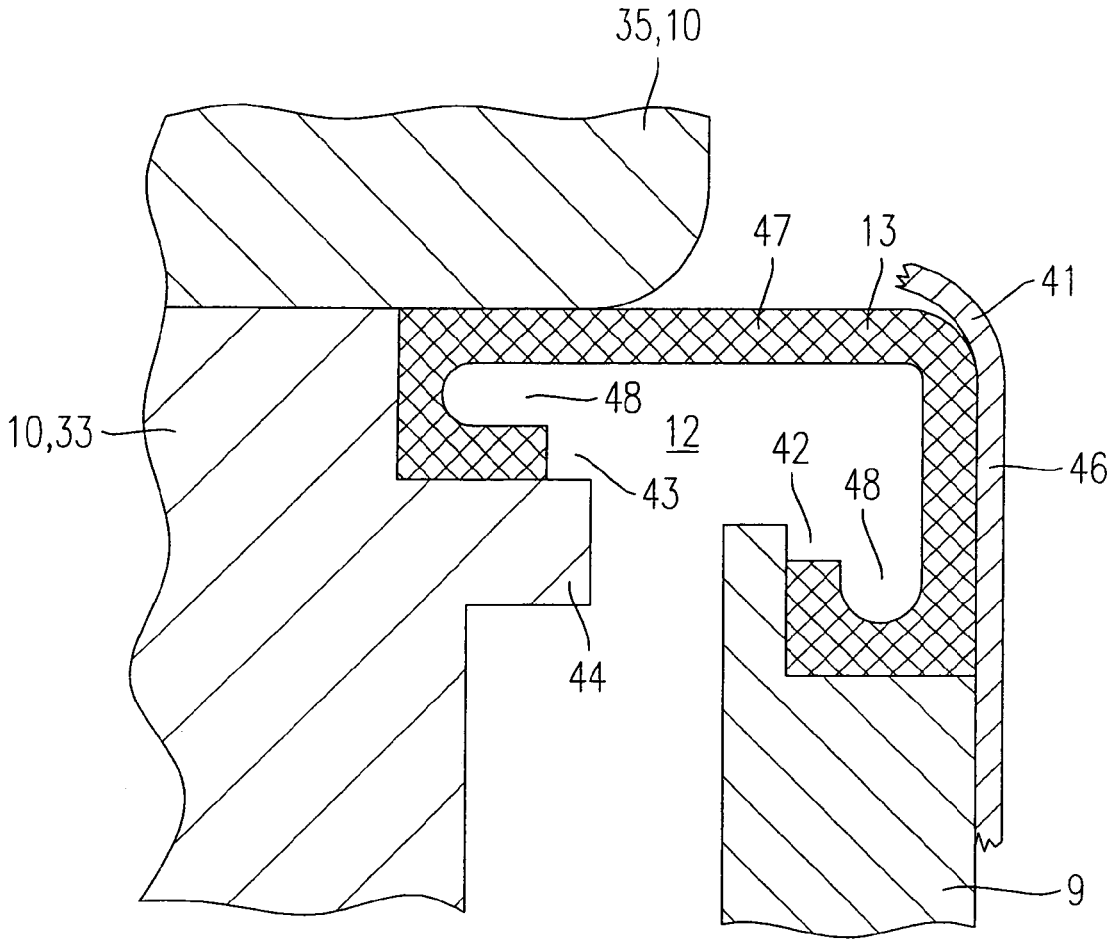
FIG. 4 shows another exemplary embodiment of a fuel injector according to the present invention, in the region of the flexible section of the coupler.

FIG. 4 shows another exemplary embodiment of a fuel injector 1 according to the present invention, in the region of flexible section 13 of coupler 7, similar to the exemplary embodiment from FIG. 3. In contrast to the exemplary embodiment shown in FIG. 3, both ends of flexible section 13 are folded over to the inside, so that cavities 48 form at the sides, facing compensating chamber 12, of the ends of flexible section 13. The ends rest in recesses 42, 43 in a hermetically sealing manner by way of their outer surfaces. The shape of cavities 48 may be semicircular, triangular, oval or polygonal, for instance.

The present invention is not restricted to the exemplary embodiments shown and suitable for various designs of fuel injectors 1, in particular also for fuel injectors 1 for self-igniting internal combustion engines and/or inwardly opening fuel injectors. All described features may be combined with each other in any manner desired.

What is claimed is:

1. A fuel injector, comprising:

a valve seat surface of a sealing seat;

a valve-closure member cooperating with the valve-seat surface;

one of a piezoelectric actuator and a magnetostrictive actuator that activates the valve-closure member;

a throttle;

a hydraulic coupler that includes a master piston, a slave piston and a coupler volume formed in-between, wherein the coupler volume communicates with a compensating chamber by way of the throttle;

a compression spring braced on at least one of the slave piston and the master piston at least one of directly and via a fixed component; and an elastic flexible section at least partially delimiting the compensating chamber;

wherein:

the coupler volume, the throttle, and the compensating chamber are filled with a hydraulic medium;

the flexible section exerts a pressure on the hydraulic medium due to prestressing;

a force of the compression spring is directed with an initial stress in such a way that the force enlarges the coupler volume;

the slave piston has a cup-shaped first slave section that includes a base partially delimiting the coupler volume;

the master piston partially surrounds the first slave section in the shape of a cup; and the throttle is arranged in the base of the cup-shaped first slave section.

2. The fuel injector as recited in claim 1, further comprising:

transverse bore via which the compensating chamber is connected to the throttle.

3. The fuel injector as recited in claim 1, wherein the compensating chamber is delimited by the flexible section, the slave piston, and the master piston.

4. The fuel injector as recited in claim 1, wherein the flexible section includes an axial section extending axially with respect to a travel direction of the slave piston, and a radial section extending radially with respect to the travel direction of the slave piston.

5. A fuel injector, comprising:

a valve seat surface of a sealing seat;

a valve-closure member cooperating with the valve-seat surface;

one of a piezoelectric actuator and a magnetostrictive actuator that activates the valve- closure member;

a throttle;

a hydraulic coupler that includes a master piston, a slave piston and a coupler volume formed in-between, wherein the coupler volume communicates with a compensating chamber by way of the throttle;

a compression spring braced on at least one of the slave piston and the master piston at least one of directly and via a fixed component; and an elastic flexible section at least partially delimiting the compensating chamber;

wherein:

the coupler volume, the throttle, and the compensating chamber are filled with a hydraulic medium;

the flexible section exerts a pressure on the hydraulic medium due to prestressing;

a force of the compression spring is directed with an initial stress in such a way that the force enlarges the coupler volume; and the throttle includes a throttling ball that is guided with a throttling gap in an opening.

6. The fuel injector as recited in claim 5, wherein the compression spring is supported via the throttling ball.

7. The fuel injector as recited in claim 5, wherein the throttling ball is braced on a surface of the master piston delimiting the coupler volume.

8. A fuel injector, comprising:

a valve seat surface of a sealing seat;

a valve-closure member cooperating with the valve-seat surface;

one of a piezoelectric actuator and a magnetostrictive actuator that activates the valve-closure member;

a throttle;

a hydraulic coupler that includes a master piston, a slave piston and a coupler volume formed in-between, wherein the coupler volume communicates with a compensating chamber by way of the throttle;

a compression spring braced on at least one of the slave piston and the master piston at least one of directly and via a fixed component;

a spring washer via which the compression spring is supported on the throttling ball; and an elastic flexible section at least partially delimiting the compensating chamber;

wherein:

the coupler volume, the throttle, and the compensating chamber are filled with a hydraulic medium;

the flexible section exerts a pressure on the hydraulic medium due to prestressing;

a force of the compression spring is directed with an initial stress in such a way that the force enlarges the coupler volume; and the throttle includes a throttling ball that is guided with a throttling gap in an opening.

9. The fuel injector as recited in claim 8, wherein the compression spring has a helical shape.

10. The fuel injector as recited in claim 8, wherein the compression spring is arranged in the slave piston inside a spring cavity.

11. A fuel injector, comprising:

a valve seat surface of a sealing seat;

a valve-closure member cooperating with the valve-seat surface;

one of a piezoelectric actuator and a magnetostrictive actuator that activates the valve-closure member;

a throttle;

a hydraulic coupler that includes a master piston, a slave piston and a coupler volume formed in-between, wherein the coupler volume communicates with a compensating chamber by way of the throttle;

a compression spring braced on at least one of the slave piston and the master piston at least one of directly and via a fixed component; and an elastic flexible section at least partially delimiting the compensating chamber;

wherein:

the coupler volume, the throttle, and the compensating chamber are filled with a hydraulic medium;

the flexible section:

exerts a pressure on the hydraulic medium due to prestressing; and includes an axial section extending axially with respect to a travel direction of the slave piston, and a radial section extending radially with respect to the travel direction of the slave piston;

a force of the compression spring is directed with an initial stress in such a way that the force enlarges the coupler volume; and at least one of:

an end formed on the radial section engages with a first recess formed on the slave piston; and an end formed on the axial section engages with a second recess formed on the master piston.

12. The fuel injector as recited in claim 11, wherein the slave piston has a cup-shaped first slave section that includes a base partially delimiting the coupler volume.

13. The fuel injector as recited in claim 12, wherein the first slave section is axially guided in the master piston with a guide play.

14. The fuel injector as recited in claim 12, wherein the master piston partially surrounds the first slave section in the shape of a cup.

15. The fuel injector as recited in claim 11, wherein the flexible section has the shape of a disk with a hole and a sleeve.

16. The fuel injector as recited in claim 11, wherein at least one of the first recess and the second recess is in the shape of a cavity.

17. The fuel injector as recited in claim 16, wherein the second recess is disposed between a connection section and a first slave section of the slave piston.

18. The fuel injector as recited in claim 17, wherein the end formed on the radial section is clamped.

19. The fuel injector as recited in claim 18, wherein the end formed on the radial section is clamped in a hermetically sealing manner.

20. The fuel injector as recited in claim 19, further comprising:

a sleeve at least partially surrounding the master piston, wherein the end formed on the axial section is clamped in a hermetically sealing manner between an outer surface of the master piston and the sleeve.

21. The fuel injector as recited in claim 11, wherein the end formed on the radial section and the end formed on the axial section are thickened.

22. The fuel injector as recited in claim 11, wherein at least one of the end formed on the radial section and the end formed on the axial section is folded over to an inside and forms a cavity, thereby producing at least one folded-over end.

23. The fuel injector as recited in claim 22, wherein the at least one folded-over end lies with an outer surface thereof in one of the first recess and the second recess in a hermetically sealing manner.

* * * * *